US005499172A

United States Patent [19]

Shiau

[11] Patent Number: 5,499,172

[45] Date of Patent: Mar. 12, 1996

[54] VARIABLE FOCUSING FLASHLIGHT

[76] Inventor: Shoei-Shuh Shiau, No. 10, Alley 1, Lane 551, Sec. 1, Wan-Shou Rd., Guei-Shan Hsiang, Tao-Yuan Hsien, Taiwan

[21] Appl. No.: 447,692

[22] Filed: May 23, 1995

[51] Int. Cl.[6] ..... F21L 7/00

[52] U.S. Cl. ..... 362/187; 362/202

[58] Field of Search ..... 362/187, 202

[56] References Cited

U.S. PATENT DOCUMENTS

| | | | |
|---|---|---|---|
| 2,137,881 | 11/1938 | Margulies | 362/202 |
| 5,126,927 | 6/1992 | Reeves et al. | 362/187 |
| 5,143,441 | 9/1992 | Maglia | 362/187 |
| 5,213,408 | 5/1993 | Shiau | 362/187 |

*Primary Examiner*—Carroll B. Dority
*Attorney, Agent, or Firm*—Darby & Darby

[57] ABSTRACT

A variable focusing flashlight includes a barrel for housing a battery therein. A tail cap is mounted on one end of the barrel and has a spring for urging the battery towards the other end of the barrel. A lamp base retains a lamp adjacent the other end of the barrel. A head assembly is mounted on the other end of the barrel and has a planar lens and a parabolic reflector with an open tail end to receive the lamp. The lamp base includes a stationary receptacle mounted to the barrel, a first conductor mounted in the stationary receptacle for connecting one terminal of the lamp to a positive terminal of the battery, a second conductor mounted in the stationary receptacle for connecting another terminal of the lamp to a negative terminal of the battery via the barrel, and a movable receptacle mounted movably on the stationary receptacle to make or break connection between the first conductor and the battery. A conductive connector has an annular plate adjacent a bottom side of the stationary receptacle, an upwardly extending plate projecting from the annular plate and sandwiched between the stationary receptacle and the barrel, and a pointed protrusion extending from the upwardly extending plate to pierce an inner anodized coating of the barrel to connect electrically with the barrel.

19 Claims, 5 Drawing Sheets

VARIABLE FOCUSING FLASHLIGHT

BACKGROUND OF THE INVENTION

1. Field of the Invention

This invention relates to a variable focusing flashlight, more particularly to a variable focusing flashlight which can be easily manufactured so as to reduce the manufacturing cost of the flashlight, and which has an improved construction for preventing light rays generated by the lamp of the flashlight from causing discomfort to the user's eyes when the flashlight is used as a candle.

2. Description of the Related Art

The improvement of this invention is directed to a conventional variable focusing flashlight which has been disclosed in U.S. Pat. No. 5,213,408 by the applicant of the present invention.

The conventional variable focusing flashlight, as disclosed, includes a barrel for housing a battery therein. A tail cap is mounted on one end of the barrel and has a compression spring provided thereon for urging the battery towards the other end of the barrel. A lamp has a pair of lamp terminals. A lamp base is used to retain the lamp adjacent the other end of the barrel.

The lamp base includes a stationary receptacle mounted within the other end of the barrel and having a bottom side and an axially extending through bore formed therein. A first conductor is mounted in the stationary receptacle and is connected electrically to one of the lamp terminals. The first conductor has one end which extends radially along the bottom side of the stationary receptacle within the circumference of the barrel. A second conductor is mounted in the stationary receptacle and couples electrically the other one of the lamp terminals and the barrel. A movable receptacle has a plate portion disposed between the stationary receptacle and the battery source. The plate portion is formed with an opening and an upward extension which extends slidably into the through bore of the stationary receptacle and which is longer than the through bore. A movable contact is provided in the opening.

The variable focusing flashlight further includes a head assembly which is mounted rotatably on the other end of the barrel and which has a substantially planar lens and a substantially parabolic reflector with an open tail end to receive the lamp. The open tail end of the reflector abuts against one end of the upward extension of the movable receptacle. The head assembly is controllably translatable along the barrel when rotated with respect to the barrel.

Rotation of the head assembly in a direction toward the barrel causes the reflector to push the movable receptacle and the battery against the action of the spring, thereby moving the movable contact away from the first conductor to break electrical connection between the lamp and the battery. Rotation of the head assembly in a direction away from the barrel causes the spring to expand and push the movable receptacle and the movable contact toward the first conductor to make electrical connection between the lamp and the battery.

The conventional variable focusing flashlight has the following drawbacks:

1. In order to enhance an appearance of the conventional flashlight, the inner and outer surfaces of the barrel of the flashlight are coated simultaneously with an anodized coating by means of anodic oxidation. The anodized coating is a relatively thin protective film which has abrasion-resistant, electrically resistant, and anti-corrosion properties. Thus, several portions of the inner anodized coating have to be scraped off so as to permit electrical contact between the barrel and the second conductor when the conventional flashlight is assembled. Owing to the above-described step, the manufacture of the conventional flashlight is therefore relatively inconvenient to conduct and results in a higher manufacturing cost.
2. When the head assembly is removed from the barrel to permit the conventional flashlight to function as a candle, the light rays generated by the lamp bulb may cause discomfort to the user's eyes.

SUMMARY OF THE INVENTION

Therefore, the main objective of this present invention is to provide a variable focusing flashlight which applies a conductive connector to interconnect electrically a barrel and a second conductor of a lamp base of the flashlight without the need for scraping off an inner anodized coating of the barrel when assembling the flashlight, thereby simplifying manufacture of the flashlight and reducing the manufacturing cost of the same.

Another objective of this invention is to provide a variable focusing flashlight which includes a light-block shield around a circumferential portion of a lamp of the flashlight to prevent light rays generated by the lamp from causing discomfort to the user's eyes when the flashlight is used as a candle.

According to this invention, a variable focusing flashlight includes a barrel for housing a battery therein. The barrel is made of a conductive material and is coated with inner and outer anodized coatings by means of anodic oxidation. A tail cap is mounted on one end of the barrel and has a compression spring provided thereon for urging the battery towards the other end of the barrel. A lamp has a pair of lamp terminals. A lamp base is used for retaining the lamp adjacent to the other end of the barrel. A head assembly is mounted rotatably and removably on the other end of the barrel and has a substantially planar lens and a substantially parabolic reflector with an open tail end to receive the lamp. The head assembly is controllably translatable along the barrel when rotated with respect to the barrel.

The lamp base includes a stationary receptacle mounted to the barrel in the other end of the barrel and having a bottom side and an axially extending through bore formed therein. A conductive connector has an annular plate adjacent the bottom side of the stationary receptacle, an upwardly extending plate projecting from the annular plate and sandwiched between the stationary receptacle and the barrel, and a pointed protrusion extending outwardly from the upwardly extending plate to pierce the inner anodized coating of the barrel so as to contact electrically the barrel. A first conductor is mounted in the stationary receptacle and is connected electrically to one of the lamp terminals. The first conductor has one end extending radially along the bottom side of the stationary receptacle within the barrel. A second conductor is mounted in the stationary receptacle and couples electrically the other one of the lamp terminals and the annular plate of the conductive connector. A movable receptacle has a plate portion disposed between the stationary receptacle and the battery. The plate portion is formed with an opening and an upward extension which extends slidably into the through bore of the stationary receptacle and which is longer than the through bore. A movable contact is provided in the opening.

The open tail end of the reflector abuts against one end of the upward extension of the movable receptacle.

Accordingly, rotation of the head assembly in a direction toward the barrel causes the reflector to push the movable receptacle and the battery against the action of the spring, thereby moving the movable contact away from the first conductor to break electrical connection between the lamp and the battery. Rotation of the head assembly in a direction away from the barrel causes the spring to expand and push the movable receptacle and the movable contact toward the first conductor to make electrical connection between the lamp and the battery.

In addition, the conductive connector further has a light-blocking shield projecting upwardly from the upwardly extending plate and extending around a circumferential portion of the lamp. Thus, the light-blocking shield can prevent light rays generated by the lamp from causing discomfort to the user's eyes when the head assembly is removed from the barrel to permit the variable focusing flashlight to function as a candle. Preferably, the light-blocking shield has an inner surface which faces the lamp and which is coated with a reflective layer.

BRIEF DESCRIPTION OF THE DRAWINGS

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
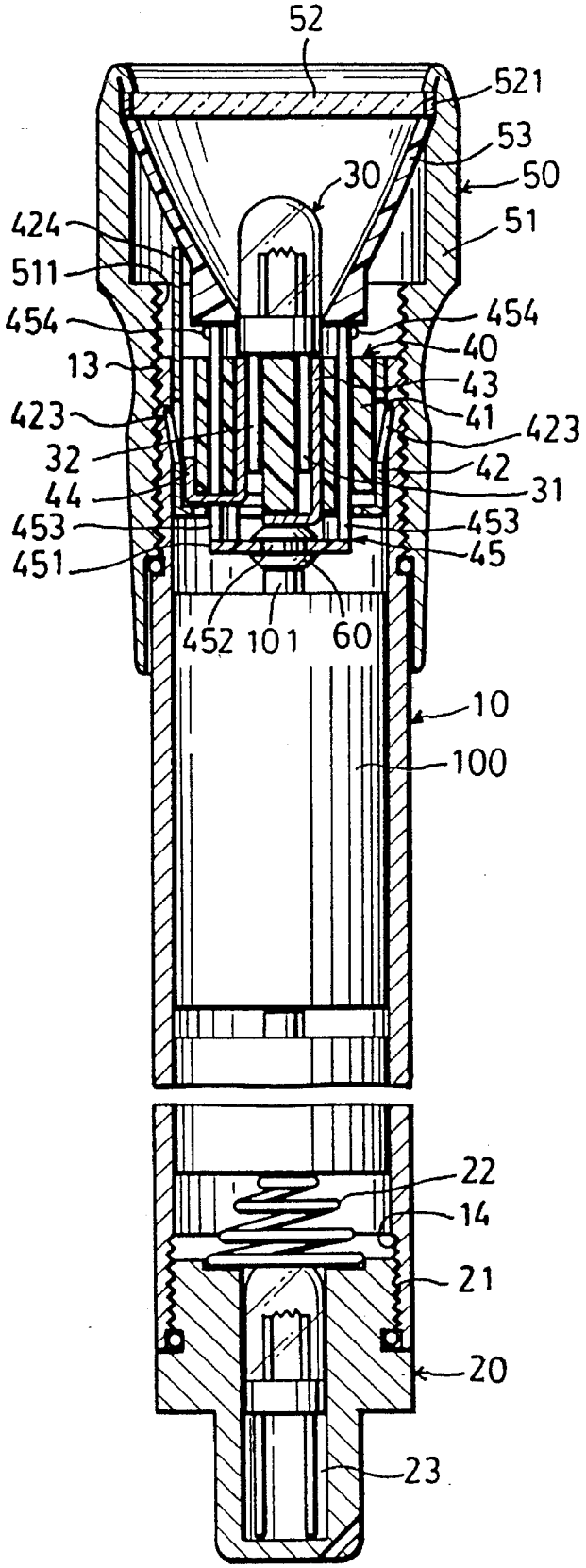
FIG. 1 is a sectional view showing the preferred embodiment of a variable focusing flashlight of this invention.
Figure 2:
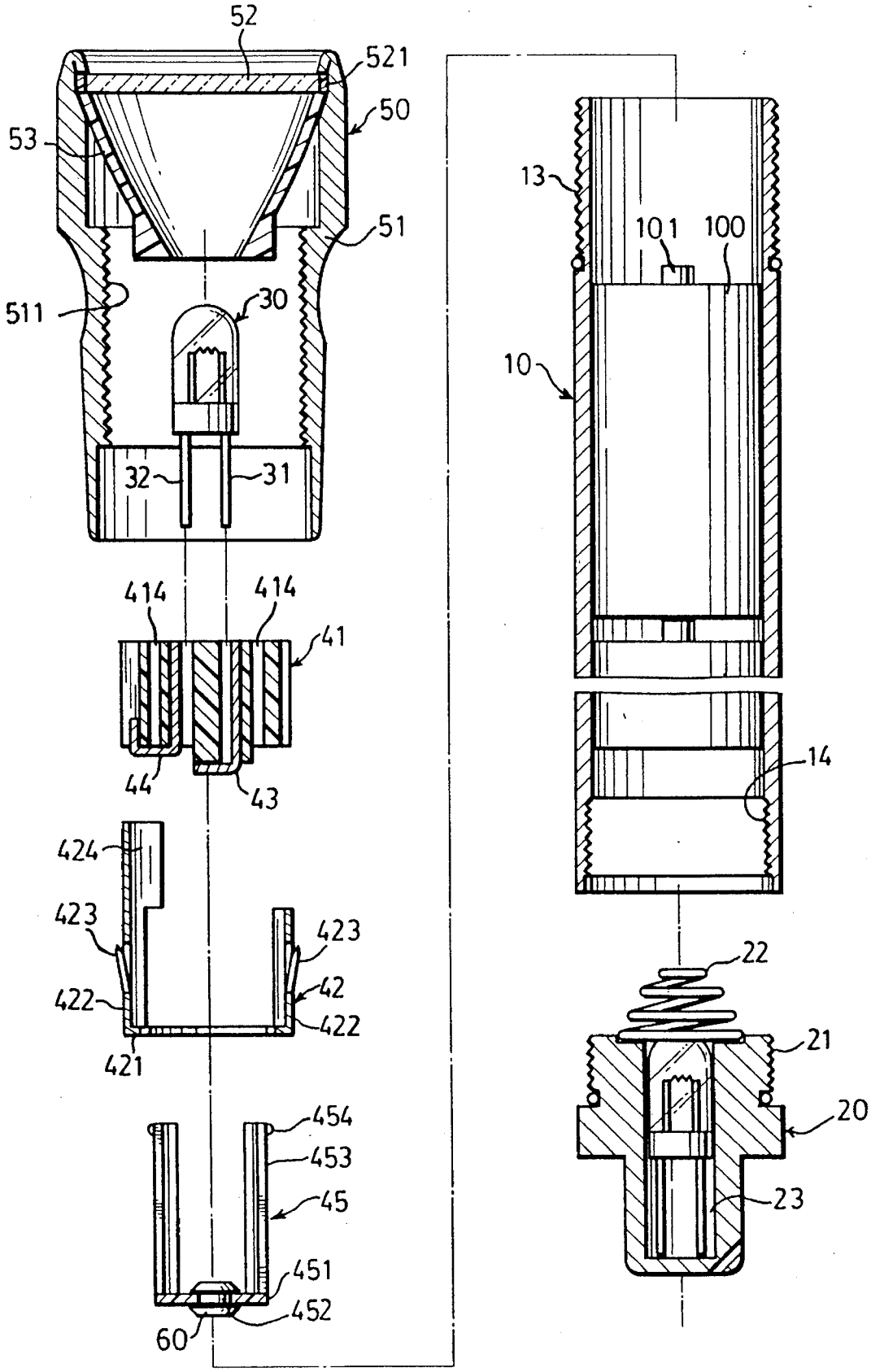
FIG. 2 is an exploded view showing the variable focusing flashlight of this invention.

Referring to FIGS. 1 and 2, the preferred embodiment of a variable focusing flashlight according to this invention includes a barrel 10, a tail cap 20, a lamp 30, a lamp base 40, and a head assembly 50.

Figure 6:
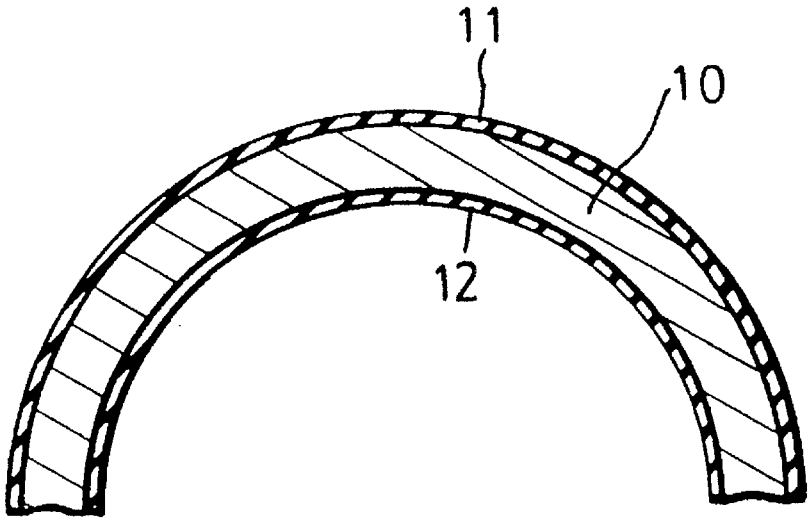
FIG. 6 is a partially sectional view showing a barrel of the variable focusing flashlight of this invention.

The barrel 10 is a tubular conductor which is adapted to receive a number of dry cell batteries 100 therein. In order to enhance appearance of the variable focusing flashlight, the barrel 10 has to be coated with outer and inner anodized coatings 11, 12 (as best shown in FIG. 6) by means of anodic oxidation. The barrel 10 has a first open end provided with an externally threaded portion 13 and a second open end provided with an internally threaded portion 14.

The tail cap 20 is also made of a conductive material and is formed with an externally threaded portion 21 so as to engage threadably the internally threaded portion 14 of the barrel 10. The tail cap 20 is provided with a conductive compressive spring 22 for biasing the dry cell batteries 100 in the barrel 10 toward the first open end of the barrel 10. The tail cap 20 is further provided with a blind axial bore 23 to receive a spare lamp therein.

The lamp 30 has a pair of lamp terminals 31, 32.

Figure 3:
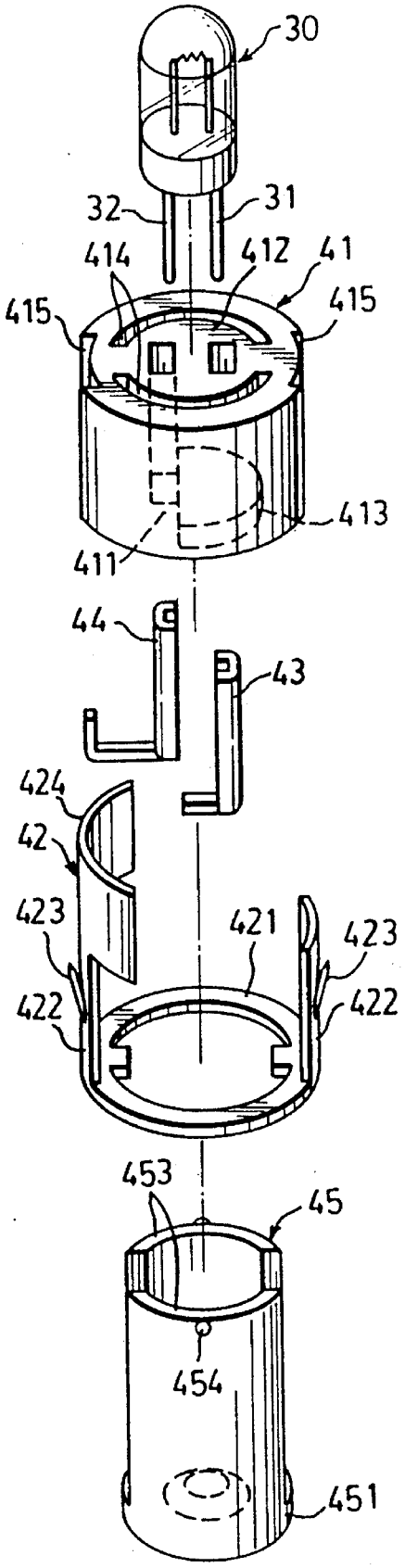
FIG. 3 is an exploded view showing a lamp base and a lamp of the variable focusing flashlight according to this invention.
Figure 4:
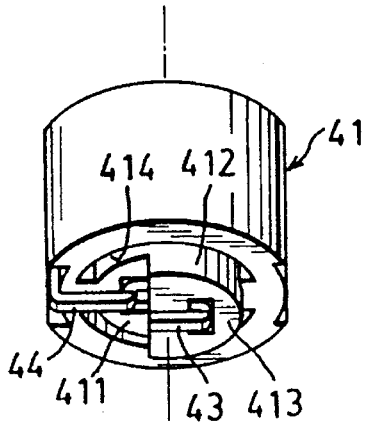
FIG. 4 is a perspective view illustrating assembly of two conductors and a stationary receptacle of the lamp base of the variable focusing flashlight in accordance with this invention.

The lamp base 40 is used for retaining the lamp 30 and is located near the first open end of the barrel 10. Referring to FIGS. 1 and 3, the lamp base 40 includes an insulating stationary receptacle 41, a conductive connector 42, first and second conductors 43, 44, and an insulating movable receptacle 45. The stationary receptacle 41, as shown in FIGS. 3 and 4, has a central portion 412 with a bottom side 411 that is formed with a downwardly extending projection 413. The first and second conductors 43, 44 are mounted in two through holes of the central portion 412 of the stationary receptacle 41, and then contact electrically the lamp terminals 31, 32 of the lamp 30 (see FIG. 1) when the lamp terminals 31, 32 are inserted into the through holes of the stationary receptacle 41. The first conductor 43 has a bent end which extends along the bottom face of the downwardly extending projection 413 so as to achieve electrical contact with one of positive terminals 101 of the dry cell batteries 100 (see FIG. 1). The second conductor 44 has a bent end which extends along the bottom side 411 of the stationary receptacle 41 and then upwardly along the periphery of the stationary receptacle 41 (see FIG. 1). The stationary receptacle 41 is further formed with a pair of arcuate through bores 414 on two sides of the central portion 412.

Referring to FIGS. 1 and 3, the conductive connector 42 has an annular plate 421 which is disposed below and near the bottom side 411 of the stationary receptacle 41, and two upwardly extending plates 422 which project from the annular plate 421 and which are sandwiched between the stationary receptacle 41 and the barrel 10. Thus, the bent end of the second conductor 44 can contact electrically the conductive connector 42. The conductive connector 42 further has two pointed protrusions 423 which extend outwardly from the upwardly extending plates 422 to pierce the inner anodized coating 12 of the barrel 10 (see FIG. 6) when the conductive connector 42 is mounted within the barrel 10, thereby making electrical connection with the barrel 10. In this way, the second conductor 44 can achieve contact electrically and indirectly with the barrel 10 via the conductive connector 42. It is noted that there is no need to scrape off portions of the inner anodized coating to achieve electrical connection between the barrel 10 and the second conductor 44 as described in the conventional flashlight. Therefore, the variable focusing flashlight of this invention is easier to manufacture and requires a lower manufacturing cost.

Figure 5:
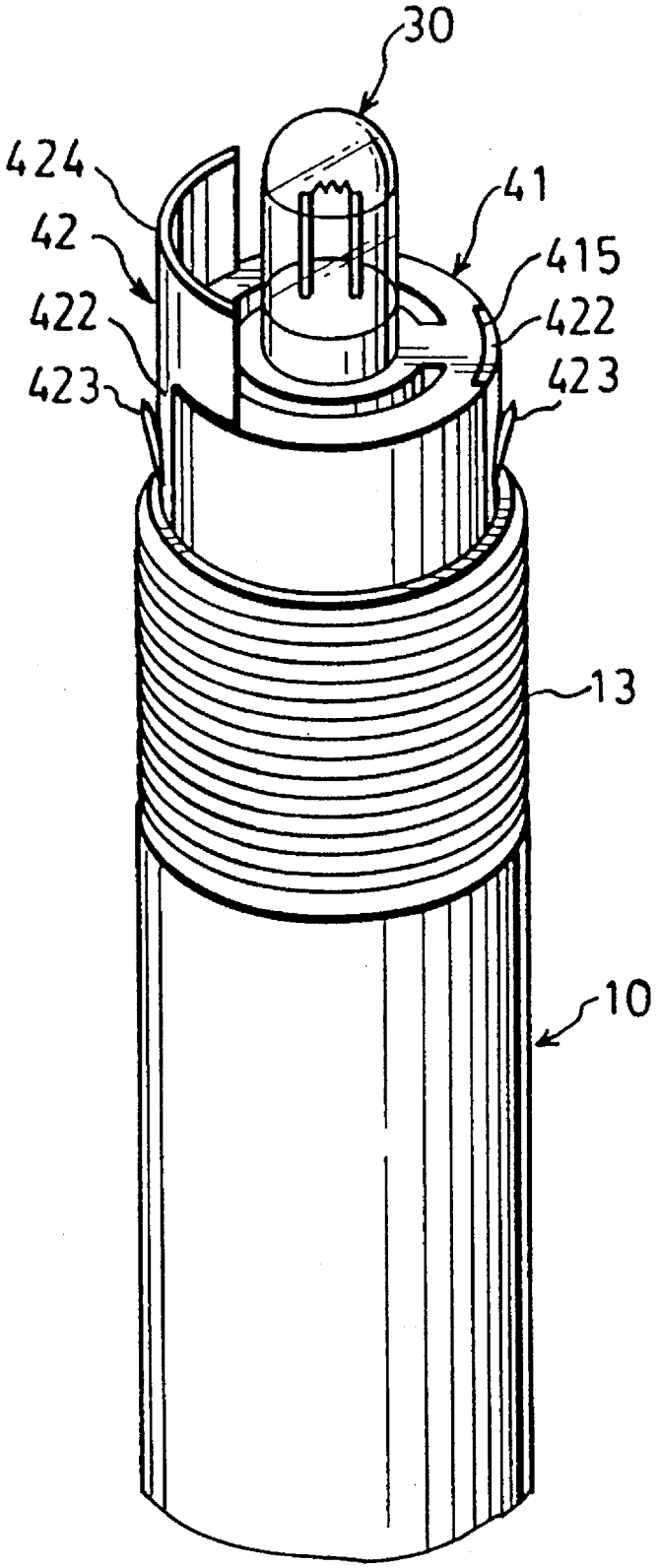
FIG. 5 is a perspective view illustrating how the variable focusing flashlight functions as a candle in accordance with this invention.

In addition, the stationary receptacle 41, as shown in FIG. 3, can be further formed with two axially extending grooves 415 for receiving the upwardly extending plates 422 of the conductive connector 42 therein (as best shown in FIG. 5) in order to position the conductive connector 42.

Referring again to FIGS. 1, 2 and 3, the movable receptacle 45 has a plate portion 451 disposed between the stationary receptacle 41 and the dry cell batteries 100. The plate portion 451 is formed with an opening 452 which receives a conductive rivet 60 that serves as a movable contact. The conductive rivet 60 is used to make or break electrical connection between the first conductor 43 and the positive terminal 101 of the dry cell batteries 100.

As shown in FIG. 1, the spring 22 of the tail cap 20 urges the dry cell batteries 100 upwardly so that the positive terminal 101 of a first one of the dry cell batteries touches the rivet 60 on the plate portion 451 of the movable receptacle 45. The movable receptacle 45 is further provided with a pair of arcuate upward extensions 453 which are formed integrally with the plate portion 451 and which extend slidably into the arcuate through bores 414 of the stationary receptacle 41 via the annular plate 421 of the conductive connector 42. Each of the upward extensions 453 has an upper end which is provided with a radial outward projection 454 so as to limit the movement of the movable receptacle 45 relative to the stationary receptacle 41 and so as to prevent untimely disengagement between the same.

Referring again to FIGS. 1 and 2, the head assembly 50 has a tubular head 51 which has a tail end provided with an internally threaded portion 511 so as to engage threadably the externally threaded portion 13 of the barrel 10. A substantially planar lens 52 and a substantially parabolic reflector 53 are press fitted into the head 51. The parabolic reflector 53 has an open tail end which extends into the first open end of the barrel 10 for permitting extension of the lamp 30 therethrough. In addition, the open tail end of the parabolic reflector 53 abuts against upper ends of the upward extensions 453 of the movable receptacle 45 (see FIG. 1). A seal ring 521 is disposed around the periphery of the planar lens 52 so as to prevent water from seeping into the head 51.

Assembly of the preferred embodiment of this invention is similar to that of the conventional variable focusing flashlight except for the additional step of coupling the conductive connector 42 and the stationary receptacle 41 of the variable focusing flashlight.

The rotation of the head 51 relative to the barrel 10 can cause axial translation of the former. Therefore, when the head 51 is rotated in a direction toward the barrel 10, the parabolic reflector 53 pushes the movable receptacle 45 and the dry cell batteries 100 downward against the action of the spring 22, thereby separating the rivet 60 from the first conductor 43. Electrical connection between the lamp 30 and the dry cell batteries 100 is therefore broken. Thus, the lamp 30 does not light at this stage. Rotation of the head 51 in a direction away from the barrel 10 causes the spring 22 to expand and push the dry cell batteries 100 and the movable receptacle 45 upward until the rivet 60 eventually touches the first conductor 43, thereby connecting electrically the lamp 30 and the dry cell batteries 100 to cause the lamp 20 to light. Further rotation of the head 51 in this direction varies the position of the parabolic reflector 53 relative to the lamp 30, thereby varying the dispersion of the light output of the preferred embodiment.

Figure 7:
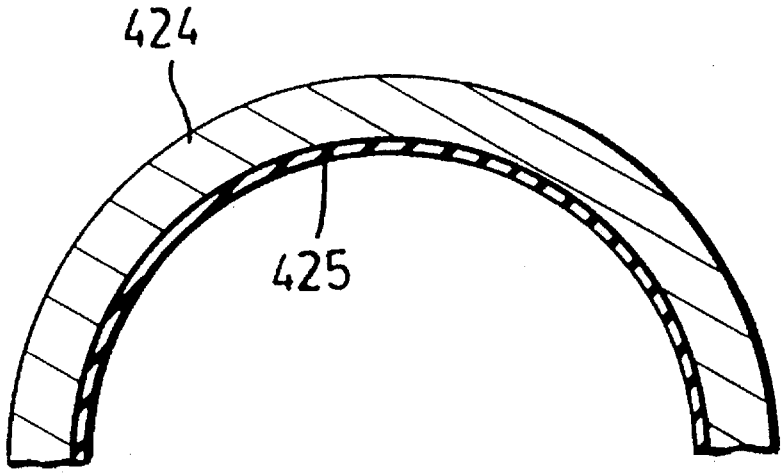
FIG. 7 is a sectional view showing a light-blocking shield of a conductive connector of the lamp base of the variable focusing flashlight according to this invention.

Preferably, the conductive connector 42 further has an arcuate light-blocking shield 424, as shown in FIG. 3, which projects upwardly from one of the upwardly extending plates 422. Referring to FIGS. 1 and 5, the light-blocking shield 424 extends around a circumferential portion of the lamp 30 and can prevent light rays generated by the lamp 30 from causing discomfort to the user's eyes when the head assembly 50 is removed from the barrel 10 to permit the variable focusing flashlight to function as a candle (see FIG. 5). In addition, the light-blocking shield 424 has an inner surface which faces the lamp 30 and which is coated with a reflective layer 425 (see FIG. 7). Thus, illumination by the variable focusing flashlight in a certain direction can be increased when the light rays generated by the lamp 30 are reflected by the reflective layer 425 of the light-blocking shield 424.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangement.

I claim:

1. A variable focusing flashlight comprising:

a barrel for housing a battery therein, said barrel being made of a conductive material and being coated with inner and outer anodized coatings;

a tail cap mounted on one end of said barrel and having a compression spring provided thereon for urging said battery towards the other end of said barrel;

a lamp having a pair of lamp terminals;

a lamp base for retaining said lamp adjacent to said other end of said barrel; and a head assembly mounted rotatably and removably on said other end of said barrel and having a substantially planar lens and a substantially parabolic reflector with an open tail end to receive said lamp, said head assembly being controllably translatable along said barrel when rotated with respect to said barrel;

said lamp base including:

a stationary receptacle mounted to said barrel in said other end of said barrel and having a bottom side and an axially extending through bore formed therein;

a conductive connector having an annular plate adjacent said bottom side of said stationary receptacle, an upwardly extending plate projecting from said annular plate and sandwiched between said stationary receptacle and said barrel, and a pointed protrusion extending outwardly from said upwardly extending plate to pierce said inner anodized coating of said barrel so as to contact electrically said barrel;

a first conductor mounted in said stationary receptacle and connecting electrically with one of said lamp terminals, said first conductor having one end extending radially along said bottom side of said stationary receptacle within said barrel;

a second conductor mounted in said stationary receptacle and coupling electrically the other one of said lamp terminals and said conductive connector;

a movable receptacle having a plate portion disposed between said stationary receptacle and said battery, said plate portion being formed with an opening and an upward extension which extends slidably into said through bore of said stationary receptacle and which is longer than said through bore; and a movable contact provided in said opening;

said open tail end of said reflector abutting against one end of said upward extension of said movable receptacle;

rotation of said head assembly in a direction toward said barrel causing said reflector to push said movable receptacle and said battery against the action of said spring, thereby moving said movable contact away from said first conductor to break electrical connection between said lamp and said battery;

rotation of said head assembly in a direction away from said barrel causing said spring to expand and push said movable receptacle and said movable contact toward said first conductor to make electrical connection between said lamp and said battery.

2. A variable focusing flashlight as claimed in claim 1, wherein said conductive connector further has a light-blocking shield projecting upwardly from said upwardly extending plate and extending around a circumferential portion of said lamp, whereby said light-blocking shield can prevent light rays generated by said lamp from causing discomfort to user's eyes when said head assembly is removed from said barrel to permit said variable focusing flashlight to function as a candle.

3. A variable focusing flashlight as claimed in claim 2, wherein said light-blocking shield has an inner surface which faces said lamp and which is coated with a reflective layer.

4. A variable focusing flashlight as claimed in claim 1, wherein movable contact is a conductive rivet mounted to said plate portion in said opening.

5. A variable focusing flashlight as claimed in claim 1, wherein said battery has a positive terminal which extends toward said opening to serve as said movable contact.

6. A variable focusing flashlight as claimed in claim 1, wherein said bottom side of said stationary receptacle has a central portion which is formed with a downwardly extending projection that extends through said annular plate of said conductive connector, said one end of said first conductor extending along a bottom face of said downwardly extending projection.

7. A variable focusing flashlight as claimed in claim 6, wherein said second conductor has one end which extends along said bottom side of said stationary receptacle and then upwardly so as to be clamped between said stationary receptacle and said upwardly extending plate of said conductive connector and couple electrically said other one of said lamp terminals and said conductive connector.

8. A variable focusing flashlight as claimed in claim 1, wherein said one end of said upward extension of said movable receptacle is provided with a radial projection for limiting the movement of said movable receptacle relative to said stationary receptacle.

9. A variable focusing flashlight comprising:

a barrel for housing a battery therein;

a tail cap mounted on one end of said barrel and having a compression spring provided thereon for urging said battery towards the other end of said barrel;

a lamp having a pair of lamp terminals;

a lamp base for retaining said lamp adjacent to said other end of said barrel;

a head assembly mounted rotatably and removably on said other end of said barrel and having a substantially planar lens and a substantially parabolic reflector with an open tail end to receive said lamp, said head assembly being controllably translatable along said barrel when rotated with respect to said barrel; and a light-blocking shield positioned on said lamp base and extending around a circumferential portion of said lamp, whereby said light-blocking shield can prevent light rays generated by said lamp from causing discomfort to user's eyes when said head assembly is removed from said barrel to permit said variable focusing flashlight to function as a candle.

10. A variable focusing flashlight as claimed in claim 9, wherein said light-blocking shield has an inner surface which faces said lamp and which is coated with a reflective layer.

11. A variable focusing flashlight comprising:

a barrel for housing a battery therein, said barrel being made of a conductive material and being coated with inner and outer anodized coatings;

a tail cap mounted on one end of said barrel and having a compression spring provided thereon for urging said battery towards the other end of said barrel;

a lamp having a pair of lamp terminals;

a lamp base for retaining said lamp adjacent to said other end of said barrel; and a head assembly mounted rotatably and removably on said other end of said barrel and having a substantially planar lens and a substantially parabolic reflector with an open tail end to receive said lamp, said head assembly being controllably translatable along said barrel when rotated with respect to said barrel;

said lamp base including:

a stationary receptacle mounted to said barrel in said other end of said barrel and having a bottom side and an axially extending through bore formed therein;

a conductive connector having an annular plate adjacent said bottom side of said stationary receptacle, an upwardly extending plate projecting from said annular plate and sandwiched between said stationary receptacle and said barrel, and a pointed protrusion extending outwardly from said upwardly extending plate to pierce said inner anodized coating of said barrel so as to contact electrically said barrel;

a first conductor mounted in said stationary receptacle and connecting electrically with one of said lamp terminals, said first conductor having one end extending radially along said bottom side of said stationary receptacle within said barrel;

a second conductor mounted in said stationary receptacle and coupling electrically the other one of said lamp terminals and said conductive connector; and a movable receptacle longer than said through bore of said stationary receptacle and extending slidably into said through bore, said movable receptacle having a first end abutting against said battery and a second end abutting against said open tail end of said reflector;

rotation of said head assembly in a direction toward said barrel causing said reflector to push said movable receptacle and said battery against the action of said spring so as to move said battery away from said first conductor to break electrical connection between said lamp and said battery;

rotation of said head assembly in a direction away from said barrel causing said spring to expand and push said battery toward said first conductor to make electrical connection between said lamp and said battery.

12. A variable focusing flashlight as claimed in claim 11, wherein said movable receptacle has a plate portion disposed between said stationary receptacle and said battery, said plate portion being formed with an opening and an upward extension which extends slidably into said through bore of said stationary receptacle and which is longer than said through bore, said open tail end of said reflector abutting against one end of said upward extension of said movable receptacle, said plate portion having a movable contact provided in said opening.

13. A variable focusing flashlight as claimed in claim 11, wherein said conductive connector further has a light-blocking shield projecting upwardly from said upwardly extending plate and extending around a circumferential portion of said lamp, whereby said light-blocking shield can prevent light rays generated by said lamp from causing discomfort to user's eyes when said head assembly is removed from said barrel to permit said variable focusing flashlight to function as a candle.

14. A variable focusing flashlight as claimed in claim 13, wherein said light-blocking shield has an inner surface which faces said lamp and which is coated with a reflective layer.

15. A variable focusing flashlight as claimed in claim 12, wherein said movable contact is a conductive rivet mounted to said plate portion in said opening.

16. A variable focusing flashlight as claimed in claim 12, wherein said battery has a positive terminal which extends toward said opening to serve as said movable contact.

17. A variable focusing flashlight as claimed in claim 11, wherein said bottom side of said stationary receptacle has a central portion which is formed with a downwardly extending projection that extends through said annular plate of said conductive connector, said one end of said first conductor extending along a bottom face of said downwardly extending projection.

18. A variable focusing flashlight as claimed in claim 17, wherein said second conductor has one end which extends along said bottom side of said stationary receptacle and then upwardly so as to be clamped between said stationary receptacle and said upwardly extending plate of said conductive connector and couple electrically said other one of said lamp terminals and said conductive connector.

19. A variable focusing flashlight as claimed in claim 12, wherein said one end of said upward extension of said movable receptacle is provided with a radial projection for limiting the movement of said movable receptacle relative to said stationary receptacle.

* * * * *